US009414718B2

(12) United States Patent
Littlehorn, Sr.

(10) Patent No.: US 9,414,718 B2
(45) Date of Patent: Aug. 16, 2016

(54) PORTABLE HAND WASHING STATION

(71) Applicant: Michael J. Littlehorn, Sr., Golden, CO (US)

(72) Inventor: Michael J. Littlehorn, Sr., Golden, CO (US)

( * ) Notice: Subject to any disclaimer, the term of this patent is extended or adjusted under 35 U.S.C. 154(b) by 0 days.

(21) Appl. No.: 14/559,909

(22) Filed: Dec. 3, 2014

(65) Prior Publication Data

US 2015/0150419 A1 Jun. 4, 2015

Related U.S. Application Data

(63) Continuation-in-part of application No. 13/209,666, filed on Aug. 15, 2011, now Pat. No. 8,925,124.

(51) Int. Cl.
*A47K 1/02* (2006.01)
*A47K 5/12* (2006.01)

(52) U.S. Cl.
CPC *A47K 1/02* (2013.01); *A47K 5/1202* (2013.01)

(58) Field of Classification Search
CPC ..... A47K 1/02; A47K 2210/00
See application file for complete search history.

(56) References Cited

U.S. PATENT DOCUMENTS 5,301,376 A * 4/1994 Herbert ..... A47K 1/02 220/379

* cited by examiner

*Primary Examiner* — Janie Loeppke
(74) *Attorney, Agent, or Firm* — Roger A. Jackson

(57) ABSTRACT

A portable hand washing station is provided that has a carrying case with an interior hand washing compartment. A case front wall includes a door to permit hand access into the interior of the hand washing compartment. A lid is connected to the case so that the lid is capable of extending in an upright vertical position. A shelf is connected to the interior surface of the lid. A pair of liquid dispensing reservoirs is supported on the shelf. Each of the reservoirs includes a top wall with a mouth opening, a bottom wall with a drain opening, and a touch operated flow valve connected to the bottom wall in liquid communication to the bottom wall. The flow valves extend in axial alignment each one of the valve openings so that a cleaning or rinsing solution is dispensed into the compartment when the flow valves are deflected by hand.

16 Claims, 6 Drawing Sheets

PORTABLE HAND WASHING STATION

RELATED APPLICATIONS

This is a continuation in part (CIP) patent application of U.S. patent application Ser. No. 13/209,666 filed on Aug. 15, 2011 by Michael J. Littlehorn Sr. of Golden, Colo., US.

TECHNICAL FIELD

The present invention relates to hand washing equipment. In particular, it relates to a portable hand washing station.

BACKGROUND OF INVENTION

Portable hand washing equipment is desirable for use in recreational, emergency, and temporary service applications. Such equipment is well known in the art, and typically includes the essential component parts of a lavatory having a water supply and spigot to control the flow of water from a liquid flow tube.

Once such device is disclosed, in U.S. Pat. No. 1,358,937, issued to Curtiss. This device is a portable lavatory having a water receptacle. With a filler cap top opening and a swing down front tray. The receptacle includes a lower discharge opening with a water spigot for discharging water into the tray. The receptacle includes an air vent and an accessory spring clamp, for holding a towel. The tray is pivotally and slidably mounted on the receptacle, and is adapted to operate so that the air vent is closed when the tray is fastened to the receptacle in an upright vertical closed position.

Improvements to the portable lavatory concept include the addition of a hand drying apparatus. For example, in U.S. Pat. No. 5,522,411 to Johnson, discloses a portable hand washing and drying station with a front hand-receiving-opening in communication with a central hand washing compartment. Above the hand washing compartment is an upper compartment with a cleansing liquid reservoir, a spigot-controlled flow tube for delivering cleansing liquid from the reservoir to the hand washing compartment, and an electrically powered fan for air drying the hands that are washed. The reservoir and fan are supported on a shelf which slides into and out of the housing. Situated below the hand compartment is a removable waste liquid receptacle for temporarily storing the used cleansing liquid.

Another such device is disclosed in U.S. Pat. No. 7,802,327 to Moceri et al. There, a portable and compact hand washing station is disclosed for use in training children. The station includes a main housing with a basin, a drain hole disposed in the basin, and a back splash panel projecting behind and above the basin. Support legs support the main housing. A reservoir is disposed in the back splash panel, and a spigot is in fluid communication with the reservoir. The spigot extends over and empties into the basin. When one positions one of the support legs inside a bathtub or shower, fluid entering the basin enters by gravity, from the reservoir and through the open-able spigot, exits via the drain hole, and empties into the bath tub or shower.

While the foregoing examples offer some utility, and together typify the existence of the background art as it relates to the field of the present invention, the prior art devices necessitate the use of either large water containing reservoirs and/or a plumbing connection. Moreover, such devices are difficult to clean, extremely heavy, and not easily transported, and are easily contaminated in use from one individual to another. Moreover, they do not provide for separate cleaning and rinsing reservoirs which are interchangeable for use in a wide variety of applications, such as for the removal of grease and grime and/or for the purpose of disinfection in food service applications, emergency services, or recreational industries. Thus, what is needed is a portable hand washing station which is self-contained, easy to clean, reduces cross-contamination, but which is also easy to transport and provides low-volume and interchangeable cleaning and rinsing reservoirs for use in a wide variety of applications. The present invention satisfies these needs.

SUMMARY OF INVENTION

It is therefore an object of the present invention to provide a portable hand washing station which is self-contained, easy to clean, and reduces cross-contamination.

It is another object of the present invention to provide a portable hand washing station which is self-contained, easy to transport, and permits efficient low water volume use of cleaning and rinsing solutions in a wide variety of applications.

To overcome problems associated with the prior art, and in accordance with the purpose(s) of the present invention, briefly a portable hand washing station is provided. The portable hand washing station is contained in a durable carrying case. The case has a pair of spaced apart side walls including a first sidewall and a second sidewall connecting a bottom wall, back wall, and front wall. The case walls define an interior hand washing compartment. The front wall is adapted to include a door which is capable of opening to permit hand access into the interior of the hand washing compartment. A lid is adapted to be connected to the case in a position which is adjacent to the back wall so that the lid is capable of extending in an upright vertical position. A shelf is connected to the interior surface of the lid. The shelf has a pair of spaced apart valve openings. A pair of liquid dispensing reservoirs is supported on the shelf. Each of the reservoirs includes a top wall with a mouth opening, a bottom wall with a drain opening, and a touch operated flow valve connected to the bottom wall in liquid communication with the drain opening. The flow valves are adapted to extend in axial alignment with a one of the valve openings so that a cleaning or rinsing solution is capable of being dispensed into the compartment when the flow valves are deflected by hand.

Additional advantages of the present invention will be set forth in the description that follows, and in part will be obvious from that description or can be learned or appreciated from practice of the invention. Moreover, the advantages of the invention can be realized and obtained by the invention as more particularly pointed out in the appended claims.

These and other objects of the present invention will become more readily appreciated and understood from a consideration of the following detailed description of the exemplary embodiment(s) of the present invention when taken together with the accompanying drawings, in which;

REFERENCE NUMBERS IN DRAWINGS

Figure 1:
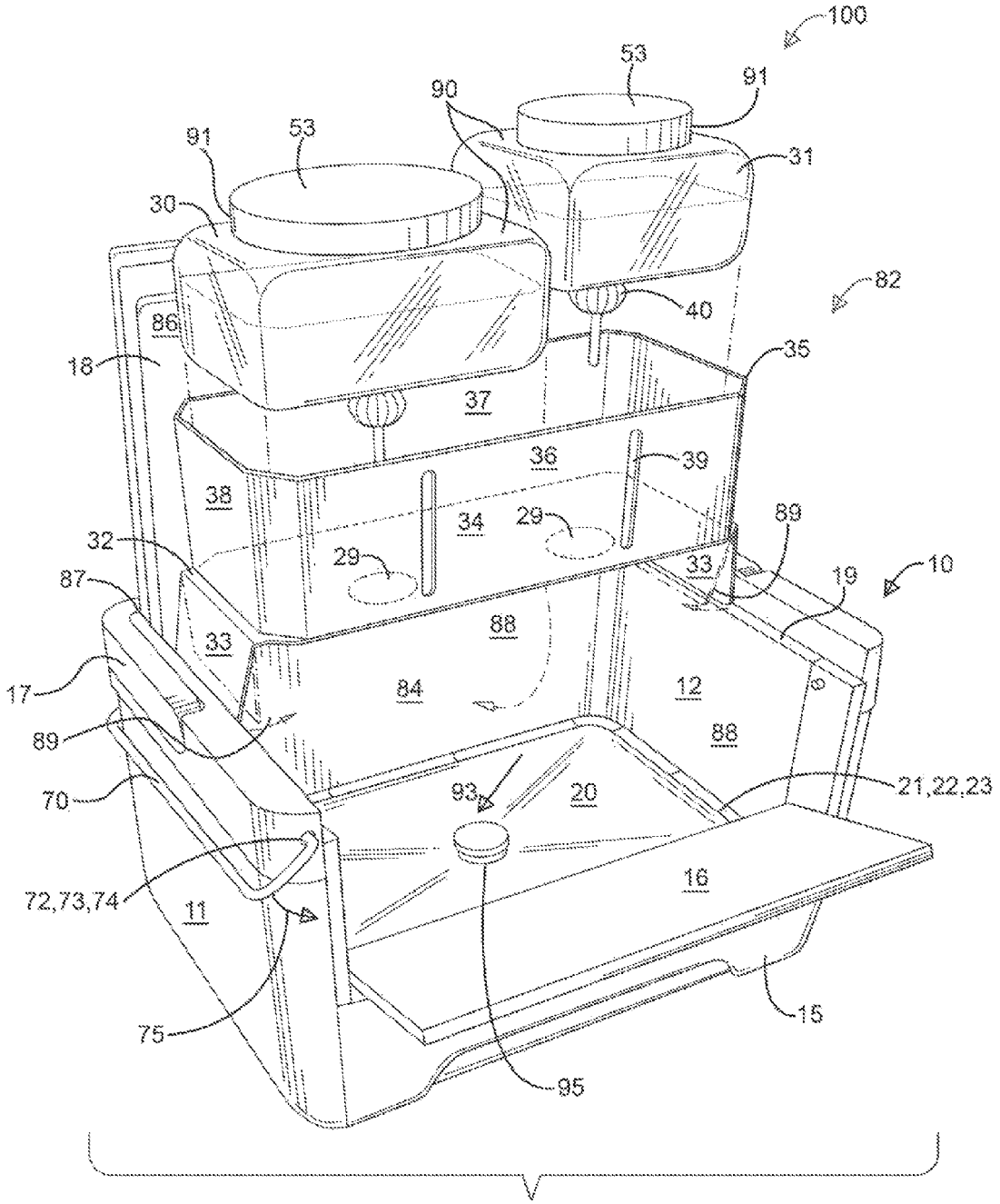
FIG. 1 is a perspective view of a preferred embodiment of the hand washing station in accordance with the present invention.
Figure 2:
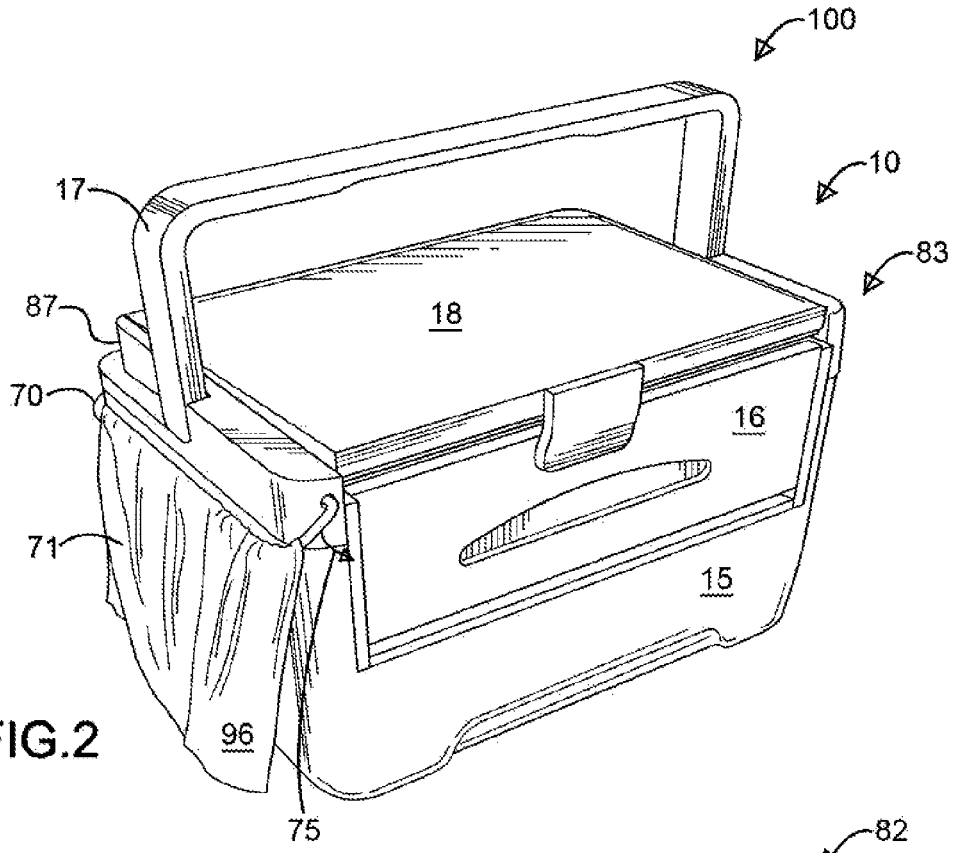
FIG. 2 is a perspective view of the preferred embodiment showing the lid in a closed transportable position, the handle in an upright carrying position, and towel bar holding the towel securely against a sidewall of the carrying case.
Figure 3:
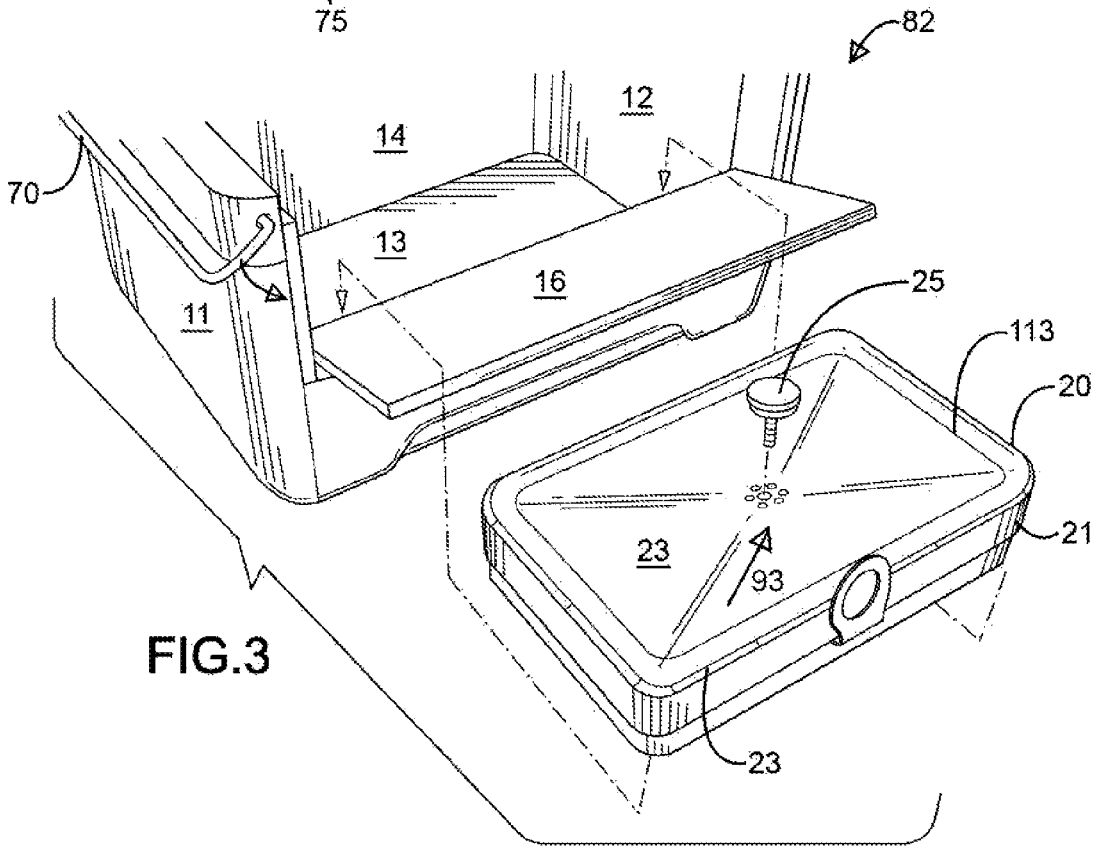
FIG. 3 is a perspective view of a portion of the front of the preferred embodiment showing the front door in an open position for hand access into the interior of the washing compartment, and the removable feature of the waste liquid carboy from the interior of the hand washing compartment.

10 Outer carrying case
11 First side wall of case 10
12 Second side wall of case 10
13 Bottom wall of case 10
14 Back wall of case 10
15 Front wall of case 10
16 Front door of case 10
17 Handle of case 10
18 Lid of case 10
19 Horizontal lip of case 10
20 Carboy
21 Outer periphery of the carboy 20
22 Slidable contact of the outer periphery 21 to sidewalls 11, 12, 14, and 15
23 Seal for carboy 20 outer periphery 21 that is a peripheral elastomeric seal
24 Top wall of the carboy 20
25 Stopper of the carboy 20
29 Clear holes or valve openings
30 Primary reservoir
31 Secondary reservoir
32 Shelf
33 Flat spring end members
34 Bottom wall of the reservoir rack 35
35 Reservoir rack for the primary 30 and secondary 31 reservoirs
36 Front wall of the reservoir rack 35
37 Back wall of the reservoir rack 35
38 Side wall of the reservoir rack 35
39 Spaced apart slots
40 Touch valve assembly
41 Internally threaded valve housing
42 Proximal end portion of the valve housing 41
43 Distal end portion of the valve housing 41
44 Inwardly tapering cylindrical opening of the valve housing 41
45 Annular valve seat of the valve housing 41
46 Valve head member
47 Valve lever arm
48 Internal spring that is disposed within the central chamber 97 and compresses against the valve head 46 and the reservoir bottom wall 51 or the cup shaped valve 60
49 External spring that has a press fit about the lever arm 47 and compresses against the inwardly tapering cylindrical opening 44
50 Central drain opening in the primary 30 and secondary 31 reservoirs
51 Bottom wall of the reservoirs 30, 31
52 Annular threaded flange of the bottom wall 51
53 Screw cap of the reservoirs 30, 31
60 Cup shaped shut off valve
61 First o-ring
62 Second o-ring
63 Top surface of the shut off valve cup 60
64 Circumferential sidewall
65 Distal annular flange
66 Plurality of openings
67 Third o-ring
70 An elongated rod in the form of a "C" shape that has a pivotal attachment to the sidewall 11 and/or 12 with the rod 70 used as a towel 96 bar
71 Pulling of the towel 96
72 Pair of ends of the elongated rod 70
73 Pivotal attachment of each end 72
74 Means for urging the elongated rod 70 to be in contact with the sidewall 11 and/or 12 via pivotal movement 75 wherein the means 74 is preferably a torsional or rotational coil spring
75 Movement of the pivotal attachment 73

76 Distal end of the valve lever arm 47
77 Distal end of the valve lever arm 47 sized and configured as a shoe
78 Closed valve 40 channel state when the top surface 63 is in contact with the bottom wall 51 of the reservoir 30, 31 drain 50 resulting in distance 80 equaling zero
79 Open valve 40 channel state when the top surface 63 is spaced away a distance 80 from the bottom wall 51 of the reservoir 30, 31 drain 50 resulting in distance 80 being greater than zero
80 Distance from the top surface 63 to the bottom wall 51 of the reservoir 30, 31 drain 50, the distance 80 which goes from zero in state 78 to a selected distance 80 in state 79 to regulate flow 98 in valve 40 positioned in the open state 99
81 Annular gap for water flow
82 Open state of the portable hand washing station assembly
83 Closed state of the portable hand washing station assembly
84 Interior hand washing compartment
85 Hand
86 Interior surface of the lid 18
87 Pivot attachment of lid 18 to back sidewall 14
88 Interior surface of the sidewalls 11, 12, 14, and 15
89 Compressing flat spring member 33 with compressible movement
90 Top wall of reservoir 30, 31
91 Mouth opening of reservoir 30, 31
92 Deflection of flow valve 40 by the hand 85
93 Funnel shaped opening if the carboy 20
94 Rinsate
95 Drain opening of the carboy 20
96 Towel
97 Central chamber of the valve housing 41
98 Flow of water
99 Open flow 98 state of the valve 40 from deflection 92
100 Portable Hand Washing Station Assembly
101 Interior of case 10 as a hand washing compartment in open state 82
102 Pivotal fulcrum
103 Flow annular gap
104 Threaded connection of valve housing 41 resulting in movement 111 of the valve housing 41 relative to the flange 52 when the housing 41 is rotated
105 Affixment of the distal annular flange 65 to valve seat 45
106 Snap fit removable engagement of the affixment 105
107 Longwise rod of lever arm 47
108 Shoe of lever arm 47
109 Water flow 98 to stay in contact with lever arm 47
110 Surface roughness of the lever arm 47
111 Movement of the threaded connection 104
112 Closed no flow 98 state of the valve 40 from no deflection 92
113 Removable engagement interface of the top wall 24 to the outer periphery 21 of the carboy 20 to make the top wall 24 removable for carboy 20 cleaning

DETAILED DESCRIPTION

Although, many methods and materials which are similar or equivalent to those described herein, can be used in the practice or testing of the present invention, the preferred methods and materials are now described. Reference will now be made in detail to the presently preferred embodiments of the invention, including the examples of which are illustrated with the accompanying drawings. In the drawings, like numerals will be used in order to represent the like features of the invention.

The present invention provides a portable hand washing station 100 for use in a wide variety of applications. The hand washing station 100 is constructed with a durable outer carrying case 10. The carrying case 10 is preferably a double wall insulated construction formed of a molded plastic. For, example, the case 10 is even more desirably constructed of a durable marine grade polyethylene so that the interior and exterior surfaces are easy to wipe clean after each use. In the presently preferred embodiment, the case 10 has an exterior dimension of 33×24.13×22.53 centimeters (L×W×H), with an interior volume of approximately 8 liters. In this configuration, the case 10 is molded in a rectangular box like shape for ease in positioning on a table, and for stacking and storage. The case includes a pair of spaced apart side walls being a first side wall 11 and a second side wall 12 connecting a bottom wall 13, back wall 14, and a front wall 15. The walls 11, 12, 13, 14, and 15 are preferably molded so that the case 10 is a one-piece water-tight shell construction. These walls 11, 12, 13, 14, and 15 define an interior hand washing compartment 84.

The front of the carrying case 10 is adapted to include a front door 16. The door 16 is of sufficient size and shape so that it is capable of opening to allow hand 85 access into the interior 84 of the hand 85 washing compartment. As shown in the drawing Figures and in the presently preferred embodiment, the door 16 is pivotally attached to the inner surface or the first 11 and second 12 side walls so that it opens on a horizontal axis. With this configuration the front wall 15 of the case 10 is the truncated lower portion of the front of the case 10. The door 16 of the upper portion is preferably constructed from a one centimeter thick sheet of durable super high density polyethylene, similar to a cutting board, which is pivotally attached to the interior of the first 11 and second 12 side walls of the case. In this manner, the lower portion of the front wall 15 remains rigidly formed as an integral construction with the first 11 and second 12 side walls and bottom wall 13 of the case 10, and is configured so that it is slightly taller than the vertical depth of the waste containing carboy 20. The lower portion thereby creates an inner chamber for containing and securing the waste 94 containing carboy 20 in the bottom of the case 10, but also extends sufficiently above the carboy 20 to act as a water containing basin, in use, so that water does not flow out of the compartment 84. Finally, the case preferably includes an integrated swing-up handle 17. The handle 17 is attached to the case 10 at a location which is adjacent to the first 11 and second 12 side walls for ease in carrying.

A lid 18 is provided for covering the interior compartment 84 of the case 10. The lid 18 may either be pivotally 87 attached to the case 10 or designed as a separate lift-off top, but, in any event, the lid 18 is necessarily designed so that it is capable of vertical support, adjacent to the back wall 14 of the case 10, in an upright open position 82 for accessing the interior 84 of the compartment, supporting the primary 30 and secondary 31 reservoirs, and alternately covering the compartment 84 in order to secure the hand washing station 110 for travel and storage.

It is preferable to construct the case 10 and lid 18 as an assembly so that the lid 18 is in pivotal connection 87 with an interior surface 88 of the first 11 and second 12 side walls. For this embodiment, either the lid 18, or the first 11 and second 12 side walls typically will include a combination of corresponding pivot pins and/or pivot pin receiving holes aligned so that they are adjacent to the back wall 14. Again, an important feature of the present invention 100, as it relates to the lid 18, is that the lid 18 is simply adapted to be capable of support, on the case 10 in an upright vertical position. The lid 18 is also constructed so that it has a rigid interior surface for either attaching a shelf 32 or for including a shelf 32 as a component of the lid 18 in an integral molded construction.

The shelf 32 is attached to the interior surface of the lid 18. The shelf 32 desirably includes a pair of spaced apart clear holes 29 for receiving the touch valves 40. The shelf 32 is thereby dimensioned so that it is capable of fitting into the compartment interior 84 when the lid 18 is pivoted downwardly in a compartment enclosing or covering position. The shelf 32 is attached to the interior surface of the lid 18, in any manner which is well known in the art, including molding the lid 18 and shelf 32 as a one-piece assembly or attaching the lid 18 with adhesives or fasteners.

As shown in the drawing Figures, and in accordance with the presently preferred embodiment, the lid 18 is pivotally attached 87 to the first 11 and second 12 side walls of the case 10. In addition a horizontal lip 19 is formed in an upper interior surface 88 of each of the first 11 and second 12 side walls and the shelf 32 further includes a pair of transverse bends or folds. The folds, or bends in the shelf sheet stock define a pair of oppositely aligned flat-spring end members 33. The spring end members 33 are adapted to project downwardly at a first extended angle so that the ends 33 are capable of engaging the lip 19 formations when the lid 18 is pivoted to an open vertical position. In this manner, the spring end members 33 act as support legs which serve to support the primary 30 and secondary 31 reservoirs, the shelf 32, and the lid 18 in an upright open vertical position. In use the flat-spring end members 33 are compressible, to a second angle, so that the spring members 33 are capable of releasing 89 support legged engagement from the lip 19 formations. Release 89 of the spring members 33 is easily performed with the fingers, of the hand 85, by slightly lifting the shelf with the palm of the hand and pinching the ends inwardly with the fingers, in order to permit the lid 18 to pivot downwardly into an closed position state position 83, for transport and storage of the hand washing station 100.

In an even more preferred embodiment of the present invention 100 and as illustrated in the drawing Figures, the interior of the hand washing compartment 84 further includes a reservoir rack 35. The reservoir rack 35 may be constructed of a thin sheet of steel but is desirably constructed as a single molded plastic body. The rack 35 has at least a front 36, back 37, and side walls 38. The back wall 37 is connected to the interior surface of the lid 18 so that the rack 35 may be secured in relation to the shelf 32, and is thereby capable of preventing movement of the primary 30 and secondary 31 reservoirs when the hand washing station 100 is subjected to a lateral force, when the lid 18 is positioned in either an open 82 or a closed 83 position. The front wall 36 of the rack 35 may also, but need not, include a pair of spaced apart clear slots 39 which are positioned so that the slots 39 permit viewing of a graduated liquid contents contained in the primary 30 and secondary 31 reservoirs. Finally, the rack 35 may include the bottom wall 34 as shown in the drawing Figures so that the rack 35 is a single molded box-like plastic body with an open top, for inserting and removing the primary 30 and secondary 31 reservoirs. Here, the bottom wall 34 also includes another pair of spaced apart clear holes, positioned in axial alignment with the valve opening clear holes 33 in the shelf 32 for receiving the touch valves 40.

A pair of liquid dispensing reservoirs being the primary 30 and secondary 31 reservoirs are supported on the shelf 32. The primary reservoir 30 can be used for containing the rinsing solution and the secondary reservoir 31 can contain the cleaning solution. In the preferred embodiment the cleaning solution is an aqueous soap solution and the rinsing solution is water. The primary 30 and secondary 31 reservoirs are preferably configured as a molded bottle shaped body which is formed from a transparent NALGENE, polypropylene, polyethylene, or polycarbonate material, in a manner which is very similar to those which one would ordinarily associate as offered for sale by chemical laboratory supply companies for use by chemical laboratory professionals. Wide-mouth bottles formed of these materials are particularly suitable, for use with the present invention, because they are easy to clean and are even amenable to high temperature, pressure. or chemical sanitization and/or sterilization depending on the intended use, as in circumstances where the desired use represents a potential for bio-hazardous contamination.

As above the primary 30 and secondary 31 reservoirs are preferably formed in a wide-mouth screw capped bottle configuration with a central drain opening 50 in the bottom wall. As shown in the drawing Figures, the bottom wall 51 of the reservoirs 30, 31 preferably includes an externally threaded annular flange 52 portion, configured about the drain opening 50 for threadably connecting of the touch operated flow valves 40. The threaded connection permits upward and downward dislocation 111 of the flow valves 40 which permits the use and operation of the cup-shaped shut-off valve 60 as more fully described below.

The wide mouth opening in the top wall also includes an externally threaded flange portion for attaching a screw cap 53. In use the screw cap 53 is easily loosened in order to vent the liquid contents of the reservoirs 30, 31 so that the liquid contents are capable of discharge through the drain openings 50. The annular flange 52 portions, in the bottom walls 50 of the reservoirs 30, 31 are necessarily formed so that they are capable or extending downwardly in axial alignment with the valve openings 29 in the shelf 32 and/or reservoir rack 35. Each of the reservoirs 30, 31 includes the touch operated flow valve 40 in threaded connection 104 to the threaded 52 bottom wall 51 to permit liquid communication with the drain opening 50. Finally, the primary reservoir 30 and the secondary reservoir 31 are desirably scaled to contain different volumetric amounts. In particular it is preferred that the primary rinsing reservoir 30 is designed to hold twice the volume of the secondary cleaning reservoir 31.

Figure 6:
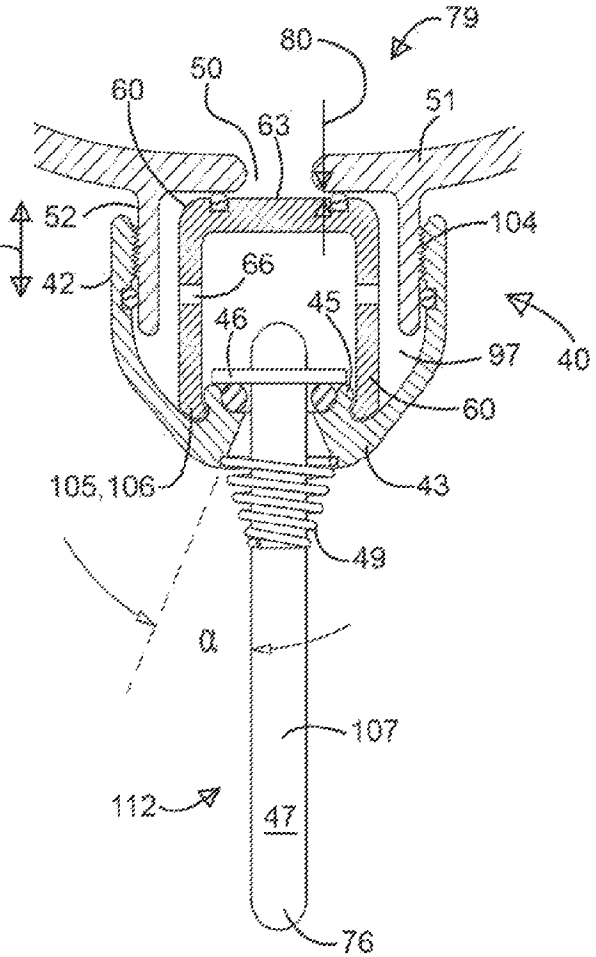
FIG. 6 is a side sectional view of yet another embodiment of the present invention where the touch valve assembly includes a spring member disposed to press fit in an annular configuration about the lever arm so that the spring member is in compressive communication with an outer retaining lip formed at a distal portion of the inwardly tapering cylindrical opening.
Figure 5:
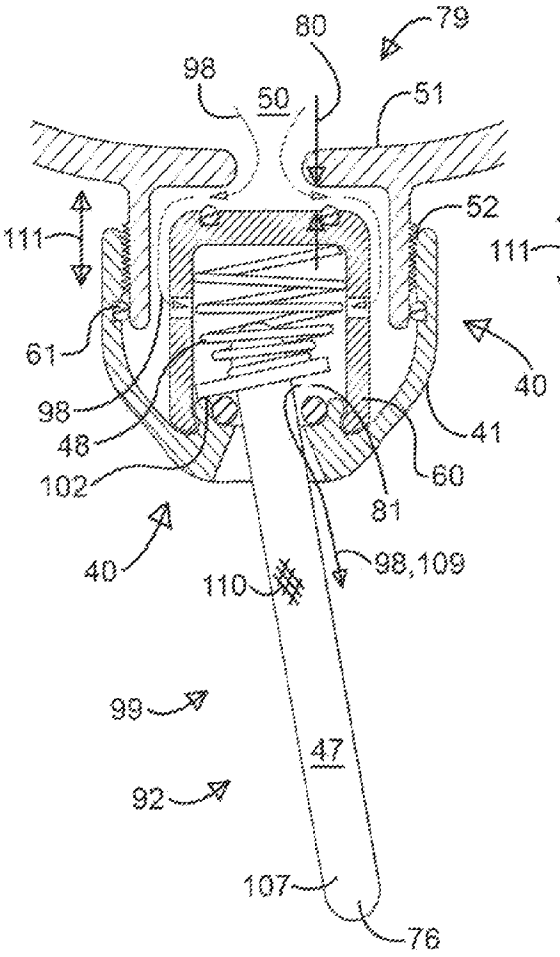
FIG. 5 is a side sectional view further illustrating the embodiment of FIG. 4 where the touch valve housing is rotated, counter-clockwise, to release the top solid portion of the cup shaped shut-off valve from the drain opening to thereby discharge a cleaning or rinsing solution through the tapered opening, and along the lever arm into the hand washing compartment.
Figure 4:
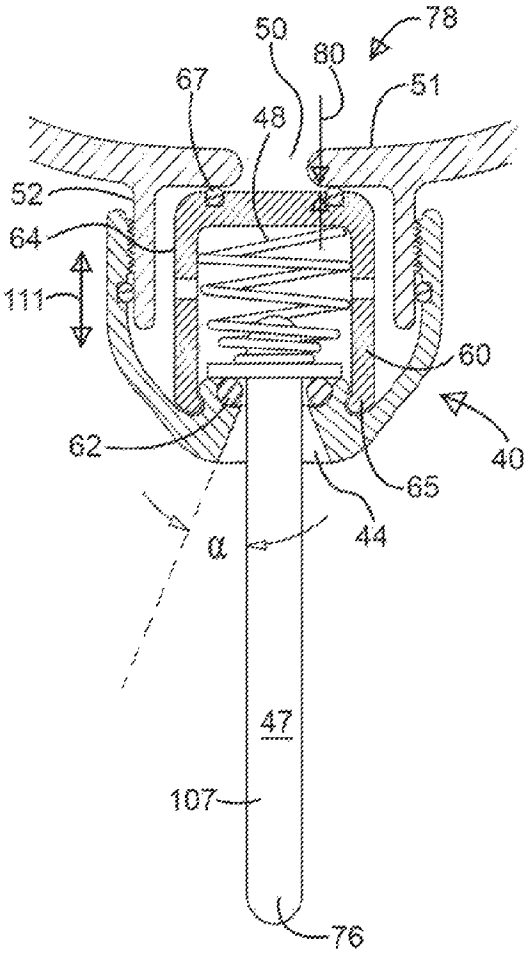
FIG. 4 is a side sectional view showing one embodiment of the touch valve assembly where the touch valve includes a spring member and shut-off valve, further the drawing figure illustrates the deflection angle for discharging a cleaning or rinsing solution, and positioning of a spring member within the valve chamber so that it is disposed against the valve lever member to permit centering and pivotal movement of the valve lever head member, between a valve closed centered position and a valve open radially displaced position.

Referring now, in particular, to the embodiments shown in FIGS. 4 to 6, the touch operated flow valves 40 include an internally threaded valve housing 41 which, in turn is threaded 104 onto the externally threaded flange 52 portion of the bottom wall 34 of the reservoirs 30, 31. The valve housing 41 has a central chamber 97, a proximal end 42 adapted for connection 10 the drain opening 50, a distal end 43 formed with an inwardly tapering cylindrical opening 44, and an interior wall formed with an annular valve seat 45. The touch operated flow valve 40 has a valve lever member, centrally mounted in the chamber. The valve lever member is formed with an annular valve head member 46 and a valve lever arm 47. The valve head member 46 is adapted to water seal against the valve seat 45. The lever arm 47 is dimensioned to extend through the inwardly tapering opening 44, into the interior of the hand washing compartment, so that a flow of water is permitted to pass between the valve lever arm 47 and the inwardly tapering opening 44 while the distal end of the lever arm 47 is deflected by hand. The inwardly tapering opening 44 is preferably constructed with an inwardly sloping conical surface so that it opens 99 fully with angular deflection (as shown in drawing FIGS. 5 and 10) of less than 25 degrees. The proximal end 42 of the valve housing 41 includes a first O-ring 61 fitted between the interior threaded portion of the proximal end 42 of the valve housing 41 and the external surface of the bottom wall 51 flanged portion 52, in order to water-seal the valve housing 41 in relation to the reservoir 30, 31 drain opening 50. A second O-ring 62 is disposed between the valve seat 45 formation and the valve head 46, of the lever member to provide a water-seal between the valve head member 46 and the valve seat 45 when the lever arm 47 is positioned in a central position. A third O-ring 67 is fitted between the top surface 63 of the shut-off valve 60 and the bottom wall 51 of the reservoir.

As mentioned above where the touch operated flow valves 40 are embodied to threadably connect to the flange portion 52 of the bottom wall 51, the touch valve 40 may, but need not further include an internal inverted cup-shaped shut-off member 60 disposed annularly about the drain opening 50. The shut-off valve 60 is defined with a solid top surface 63 which biases against and to seal, the drain opening 50 and a circumferential sidewall 64 with a distal annular flange 65. The circumferential side wall 64 includes a plurality of openings 66 such as holes or slots for channeling the cleaning and rinsing solutions 98 into the central chamber 97 of the valve housing 41. The distal annular flange 65 or lip, shaped portion is adapted to snap-fit 106 a complimentary formation in the inner wall of the central chamber 97 so that shut-off valve 60 operates in open 79 and closed 78 cooperation with the valve housing 41 when the valve housing 41 is rotated in a counter clockwise and clockwise directions respectively causing movement 111.

The shut-off valve 60 is adapted to cooperate with the valve housing 41 to open 79 and close 78 open channel flow 98 into the central chamber 97. When the touch valve 40 is rotated in a tightened, or clockwise direction, the solid top surface 63, of the shut-off valve 60 biases against the drain opening 50 so that the liquid now is stopped and contained in a closed channel condition 78 wherein distance 80 equals zero. When the touch valve 40 is loosened, in a counter-clockwise direction the solid top surface 63 of the shut-off valve 60 is disposed in a spaced relationship via distance 80 below the drain opening 50 so that an open channel condition 79 permits liquid flow 98 of solution into the central chamber 97, of the touch valve housing 41, and permits dispensing of the liquid 98 for hand 85 washing when the lever arm 47 is deflected by hand 85.

Thus by connecting the distal portion of the shut-off valve 60, about the annular valve seat 45 to the inner wall of the valve housing 41, and threading 104 the valve housing 41 onto the bottom wall 51 of the reservoir 30, 31, one may alternately rotate the valve housing 41 to either engage 78 or disengage 79 the shut-off valve 60 from the drain opening 50. It follows that, in operation rotation of the valve housing 41 in this manner, further permits one to meter or control the flow 98 of the liquid contents, of the reservoirs, in proportion to the degree of rotation of the valve housing 41. This feature is particularly useful, in providing flexibility. in applications where one intends to use differing concentrations, or formulations, of cleaning solutions in relation a volume of rinsing solution.

Figure 7:
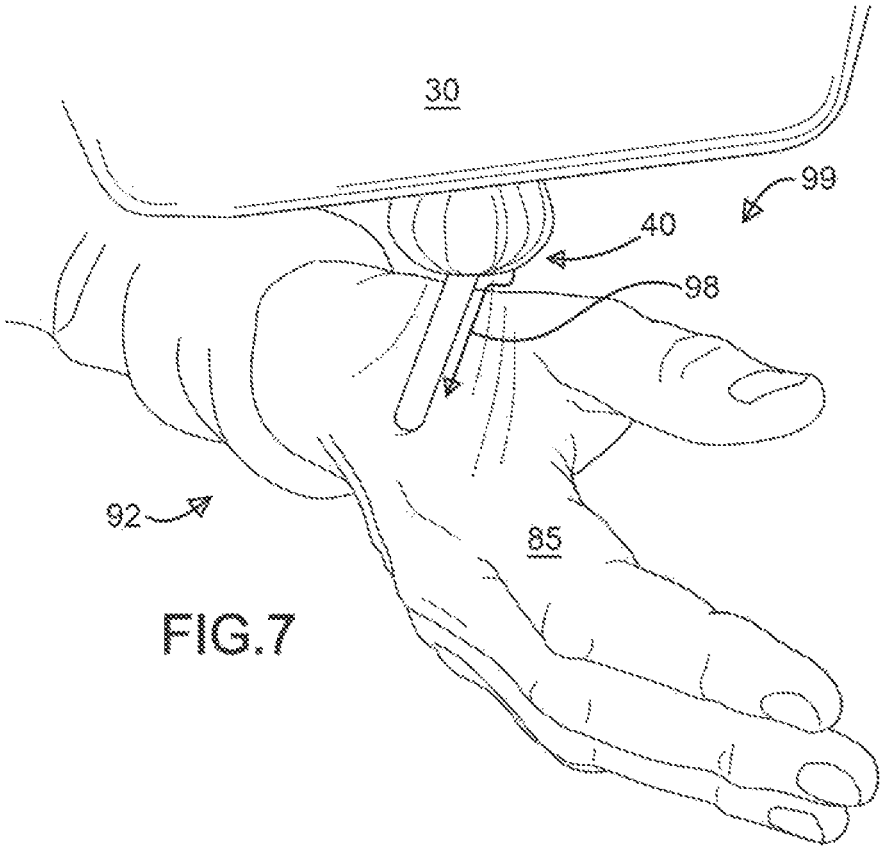
FIG. 7 is an anatomical representation showing operation of the touch valve by lateral deflection, with the hand.
Figure 8:
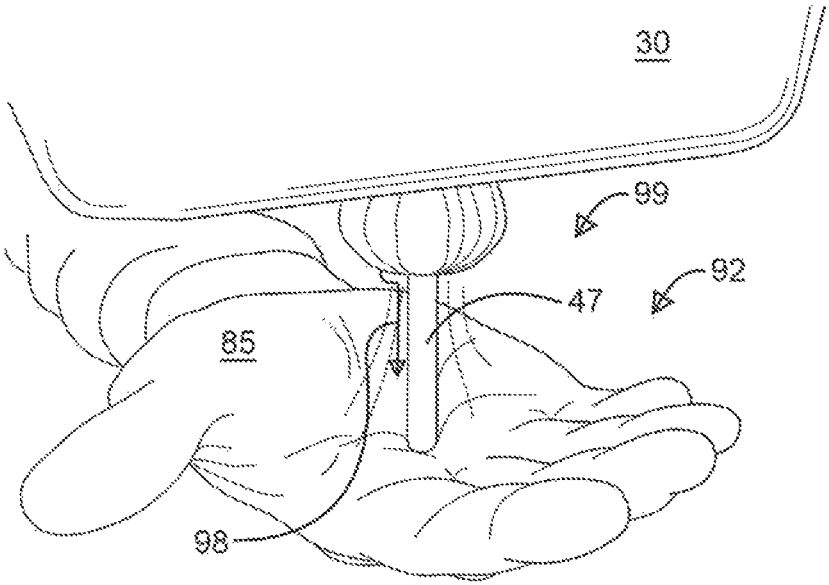
FIG. 8 is an anatomical representation showing operation of the touch valve by upward deflecting the touch valve, with the hand.
Figure 10:
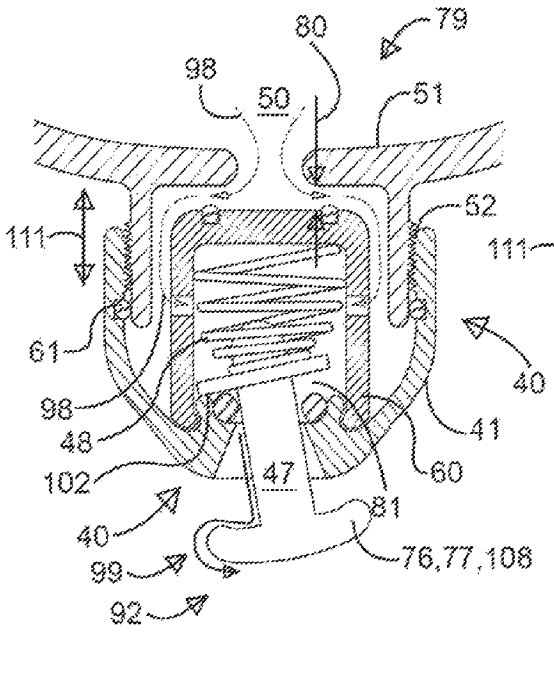
FIG. 10 is a side sectional view further illustrating the embodiment of FIG. 9 where the touch valve housing is rotated, counter-clockwise, to release the top solid portion of the cup shaped shut-off valve from the drain opening to thereby discharge a cleaning or rinsing solution through the tapered opening, and along the lever arm that terminates in a shoe portion into the hand washing compartment.
Figure 9:
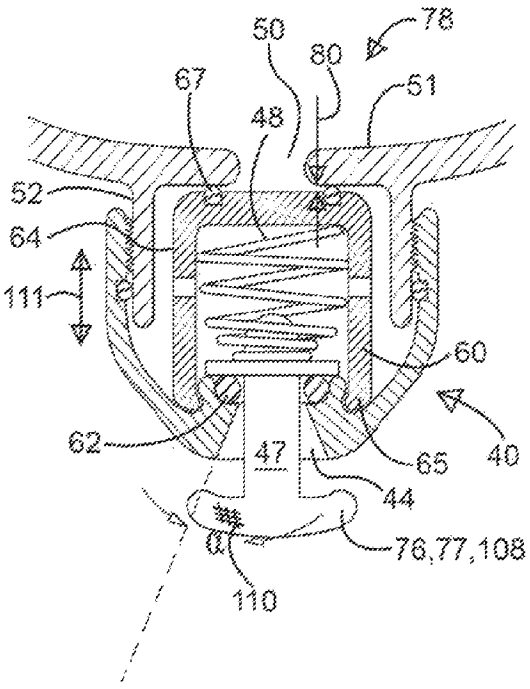
FIG. 9 is a side sectional view showing another embodiment of the touch valve assembly where the touch valve includes a spring member and shut-off valve, the drawing figure illustrates the deflection angle for discharging a cleaning or rinsing solution, and positioning of a spring member within the valve chamber so that it is disposed against the valve lever member that terminates in a shoe portion to permit centering and pivotal movement of the valve lever head member, between a valve closed centered position and a valve open radially displaced position.
Figure 12:
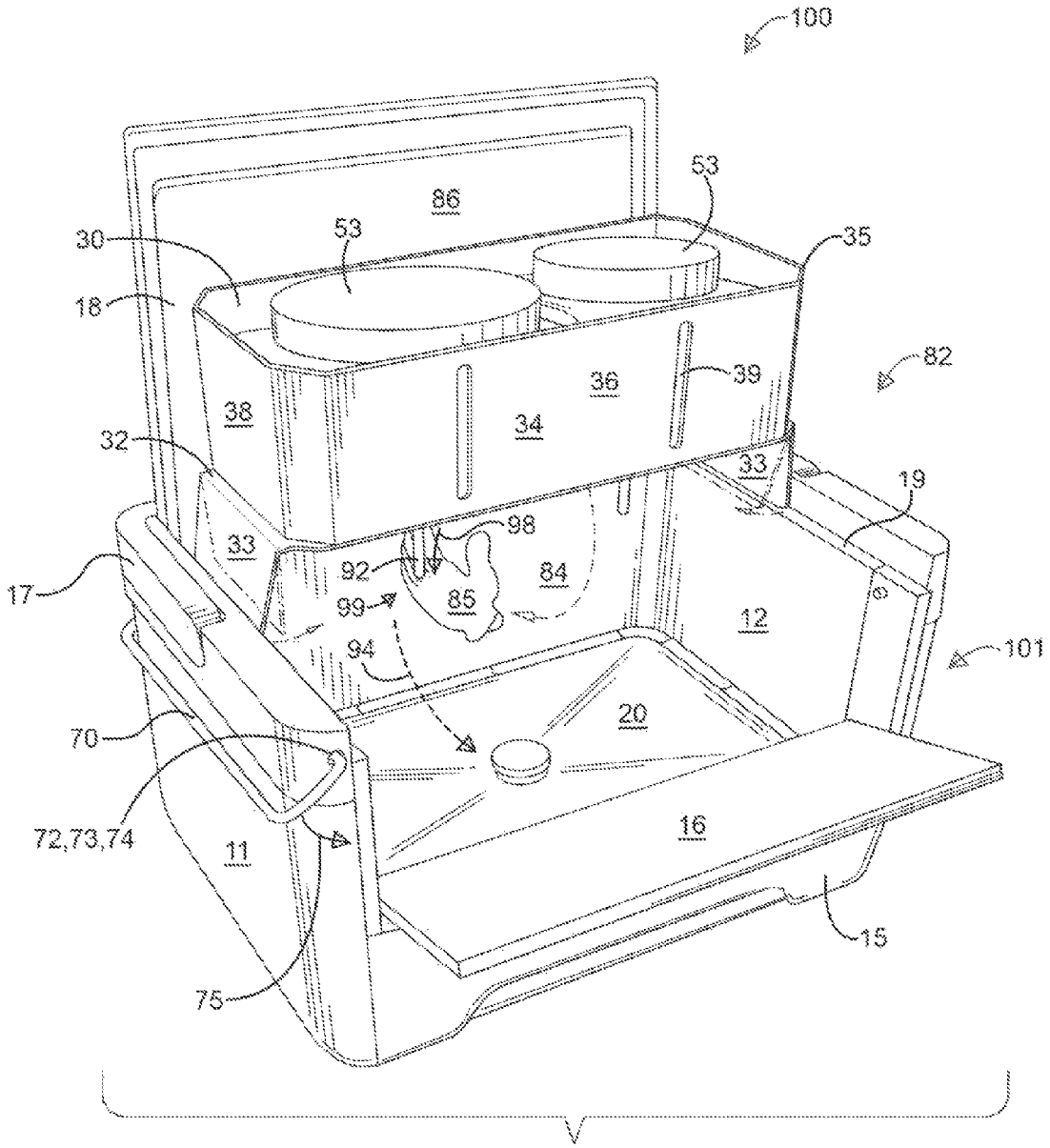
FIG. 12 is a perspective view of a preferred embodiment of the hand washing station in accordance with the present invention close to what is shown in FIG. 1 except that the reservoirs are lowered into the reservoir rack such that the hand washing station is in its normal use scenario with the hand washing station in an open state with a user's hand using the hand washing station via deflecting the touch valve to initiate the flow of cleansing liquid with the hand positioned below the reservoirs and the user's hand is positioned above a carboy to collect a rinsate.

The shut-off valve member 60 includes a plurality of openings 66 in the sidewall 64 to permit the flow of liquid from the drain opening 50 of the reservoirs 30, 31, past the top solid surface 63 of the shut-off valve 60, through the openings 66 in the sidewall 64, and into the central chamber 97 of the valve housing 41. The dashed line illustrations in FIGS. 5 and 10 show this flow pattern in accordance with this embodiment. Thus in FIGS. 5 and 10 when the valve housing 41 is rotated to a loosened position and the shut-off valve 60 is disposed downwardly, so that the top solid surface 63 is disengaged from the drain opening 50 via distance 80 in open state 79, and liquid flows 98 through the clear openings 66 in the circumferential sidewall 64, of the shut-off valve 60 and into the central chamber 97 for dispensing when the lever arm 47 is deflected 92 by hand 85. This operation by deflection is further illustrated in drawing FIGS. 7, 8, and 12.

Figure 11:
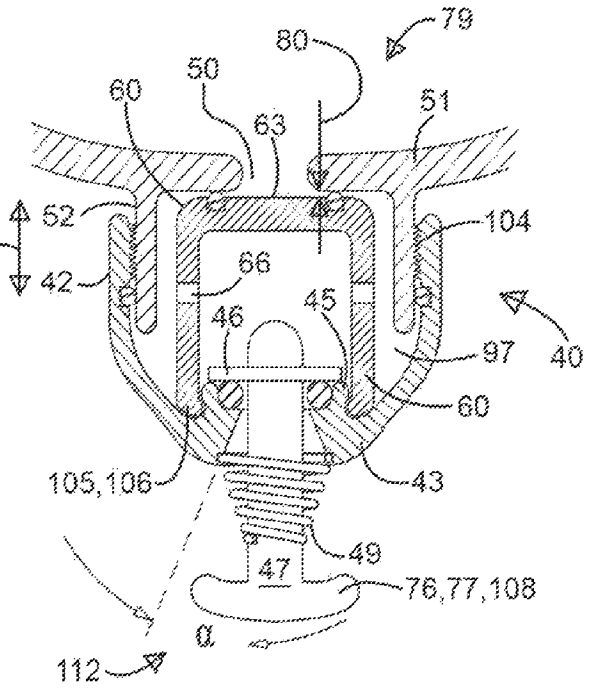
FIG. 11 is a side sectional view of yet another embodiment of the present invention where the touch valve assembly includes a spring member disposed to press fit in an annular configuration about the lever arm so that the spring member is in compressive communication with an outer retaining lip formed at a distal portion of the inwardly tapering cylindrical opening.

Referring again to drawing FIGS. 4 to 6 and 9 to 11, the touch operated flow valve 40 also includes a spring member 48 or 49 that is either internal 48 or external 49 which is capable of biasing against the valve lever member to permit centering and pivotal movement 102 of the valve lever head member 46, within the chamber 97, between a valve closed 112 and centered position and a valve open 99 and radially displaced position. These drawing Figures illustrate two of the presently preferred embodiments for positioning of the spring member 48, 49 in relation to the valve lever member. In the first embodiment, of FIGS. 4, 5, 9, and 10 the spring member 48 is disposed in the central chamber 97 and is adapted to annularly compress against the valve head 46 and the cup 60. With the second embodiment, of FIGS. 6 and 11, the spring member 49 is positioned to press fit about the lever arm 47 so that it is capable of making a compressive communication with the inwardly tapering cylindrical opening 44.

As mentioned briefly above, a waste liquid carboy 20 is disposed adjacent to the bottom wall 13 of the compartment, in a spaced relationship below the touch operated flow valves 40. The waste liquid carboy 20 is also preferably constructed as a plastic molded body which fanned of transparent NALGENE, polypropylene, polyethylene, or polycarbonate materials. The carboy 20 is further dimensioned in a configuration so as to permit a substantially water tight fit via the slidable contact 22 against the interior surfaces 88 of the back 14, side 11, 12, and the lower portion of the front wall 15 of the carrying case 10. In the alternative, the periphery 21 of the carboy 20 may, but need not, further include a peripheral water seal 23, such as a plastic or rubber nap or skirt which biases against the interior surfaces 88 of the carrying case 10.

The waste liquid carboy 20 has a top wall 24 with a funnel shaped 93 draining to the opening 95 so that it is adapted to collect the contaminated rinsate 94 from the hands 85. The carboy 20 is removable, by lifting from the interior of the compartment 84 for disposal of the rinsate 94 and cleaning of the carboy 20. The carboy 20 desirably includes a stopper 25 or cap. Where the intended use is in conjunction with normal hand 85 washing applications, the carboy 20 desirably includes a drain opening (not shown) in a bottom wall. However, as mentioned above the present invention 100 is also designed for use in an emergency, or bio-hazardous conditions, where the carboy 20 is simply capped and disposed of with a new carboy 20 retrofit in the interior 84 of the case 10 compartment.

Finally it is also desirable to further include a towel bar 70 which is pivotally 73 attached to the case 10 or sidewalls 11 and/or 12. The towel bar 70 may, but need not, include a cam actuated bar-end member in pivotal attachment 73 with the carrying case 10 so that in use, the towel bar 70 biases or urges 75 compressively downward against an exterior surface of a side wall 11 and/or 12, via means 74 so that the towel bar 70 secures the towel 96 against pulling 71 or tearing with a drying motion by hand 85 or by wind in the environment.

CONCLUSION

Accordingly, the present invention of the portable hand washing station has been described with some degree of particularity directed to the embodiment(s) of the present invention. It should be appreciated, though; that the present invention is defined by the following claims construed in light of the prior art so modifications or changes may be made to the exemplary embodiment(s) of the present invention without departing from the inventive concepts contained therein.

The invention claimed is:

1. A portable hand washing station, comprising:

(a) a durable carrying case including a pair of spaced apart sidewalls that include a first side wall and a second side wall, a back wall, and a front wall, all connecting to a bottom wall, said walls defining an interior hand washing compartment, and whereby said front wall is adapted to include a door capable of opening to permit hand access into said interior of the hand washing compartment;

(b) a lid adapted to be connected to said case, wherein said lid is capable of support on said case in an open vertical position, and wherein said lid further includes a shelf connected to an interior surface of said lid, said shelf having a pair of spaced apart valve openings, wherein said lid is pivotally attached to said sidewalls of the case, a horizontal lip is formed in an upper interior surface of each of said sidewalls, and said shelf further includes a pair of transverse folds defining a pair of oppositely aligned flat spring end members adapted to project downwardly at a first extended angle capable of engaging said lip formations when said lid is pivoted to an open vertical position, said flat spring end members are compressible to a second angle so that said flat spring members are capable of releasing engagement from said lip formations to permit said lid to pivot downwardly into an enclosing position for transport and storage;

(c) a pair of liquid dispensing reservoirs supported on the lid including a primary reservoir and a secondary reservoir, each of said reservoirs including a top wall including a mouth opening, a bottom wall including a drain opening, and a touch operated flow valve connected to the bottom wall in liquid communication with said drain opening, wherein said flow valves are adapted to extend into said interior hand washing compartment when said flow valves are deflected by hand, wherein said flow valves are capable of extending through said valve openings into the interior of the compartment, wherein operationally when said lid is placed into said open vertical position defined as an open state of said portable hand washing station, said pair of reservoirs are elevated to provide space within said case interior wherein with said door open creating said interior hand washing compartment thus giving access to hands for utilizing said touch flow valves and further a closed state of said portable hand washing station defined as said lid being in said downward and enclosed position for transport and storage wherein said reservoirs are lowered into said case interior; and (d) a waste liquid carboy disposed adjacent to said bottom wall of said compartment in a spaced relationship below said touch operated flow valves, said waste liquid carboy including a top wall with a funnel shaped opening adapted to collect a rinsate from said valves and said reservoirs, said carboy further includes an outer periphery that is in a slidable contact with said first side wall, said second side wall, said back wall, and said front wall, wherein a peripheral elastomeric seal is disposed at said slidable contact, wherein operationally said seal further helps prevent the rinsate from wino in-between said carboy and said walls.

2. The portable hand washing station according to claim 1, wherein said carboy further includes a drain opening and said funnel shaped opening includes a stopper, further included in said carboy is a removable engagement interface in-between said top wall and said outer periphery that is operational to facilitate said top wall to be removable from said outer periphery for cleaning of said carboy.

3. The portable hand washing station according to claim 1, further comprising an elongated rod having a pair of ends, wherein said elongated rod is formed in the shape of a "C", wherein each said end is pivotally attached to said sidewall, further included is a means for urging said elongated rod to be in contact with said sidewall via a movement through said pivotal attachments, wherein operationally said elongated rod acts as a drying towel bar that through said means for urging clamps a towel as between said elongated rod and said sidewall to keep the towel in place in windy environmental conditions.

4. The portable hand washing station according to claim 1, wherein each of said dispensing reservoirs are transparent and said mouth opening of each reservoir is a screw cap assembly.

5. The portable hand washing station according to claim 1, wherein said pair of dispensing reservoirs include a cleansing liquid reservoir and a rinsing liquid reservoir, said reservoirs are dimensioned in volume so that said cleansing liquid reservoir contains a volume in a range of one-third to two-thirds a volume of said rinsing liquid reservoir.

6. The portable hand washing station according to claim 1, wherein said touch operated flow valves include a valve housing formed with a central chamber, a proximal end adapted for connection to said drain opening, a distal end formed with an inwardly tapering cylindrical opening, and an interior wall formed with an annular valve seat, said touch operated flow valve further including a valve lever member, centrally mounted in said chamber, including an annular valve head member and a valve lever arm, wherein said valve head member is adapted to water seal against said valve seat, and said lever arm is dimensioned to extend through said inwardly tapering opening into said interior of said washing compartment so that a flow of water is permitted to pass between said valve lever arm and said inwardly tapering opening when said distal end of the lever arm is deflected by a hand.

7. The portable hand washing station according to claim 6, wherein said touch operated flow valve further comprises a spring member capable of biasing against said valve lever member to permit centering and pivotal movement of said valve lever head member within said chamber between a valve closed centered position and a valve open radially displaced position.

8. The portable hand washing station according to claim 7, wherein said spring member is disposed in said central chamber and is adapted to annularly compress as against said valve head from said reservoir bottom wall.

9. The portable hand washing station according to claim 7, wherein said spring member is positioned to press fit about said lever arm in compressive communication with the inwardly tapering cylindrical opening.

10. The portable hand washing station according to claim 1, wherein said interior of said hand washing compartment further includes a reservoir rack having a front, a back, and side walls, wherein said back wall is connected to an interior surface of said lid so that said rack is secured on said shelf and is thereby capable of preventing movement of said reservoirs when said portable hand washing station is subjected to a lateral force.

11. The portable hand washing station according to claim 10, wherein said front wall of said rack includes a pair of spaced apart clear slots positioned so that said slots permit viewing of a graduated liquid volume contained in said reservoirs.

12. A portable hand washing station, comprising:

(a) a durable carrying case including a pair of spaced apart sidewalls that include a first side wall and a second side wall connecting a bottom wall, a back wall, and a front wall, said walls defining an interior hand washing compartment, and whereby said front wall is adapted to include a door capable of opening to permit hand access into said interior of the hand washing compartment;

(b) a lid adapted to be connected to said case;

(c) a pair of liquid dispensing reservoirs supported on said lid, including a primary reservoir and a secondary reservoir, each of said reservoirs including a top wall having a mouth opening and a bottom wall including a drain opening; and (d) a touch operated flow valve connected to said bottom wall in liquid communication with said drain opening, each said flow valve including a valve housing formed with a central chamber, a proximal end adapted for connection to said drain opening, a distal end formed with an inwardly tapering cylindrical opening forming a portion of a frustroconical shape that is a symmetrically continuous opening, and an interior wall formed with an annular valve seat protrusion shaped as an annular continuous raised ridge, said touch operated flow valve including a valve lever member centrally mounted in said chamber therethrough said inwardly tapering cylindrical opening, said valve lever member including an annular valve head member and a valve lever arm, wherein said valve head member is adapted to water seal against said valve seat, and said lever arm is dimensioned to extend through said inwardly tapering opening into said interior of said washing compartment, wherein operationally a flow of water is permitted to pass between said valve lever arm and said inwardly tapering opening when a distal end of said lever arm is deflected by hand in an omnidirectional manner, said flow valve annular continuous raised ridge peripherally circumferentially nests a second o-ring, forming said water seal as between said valve head and said valve seat, wherein operationally when said lever arm is laterally deflected by hand in an omnidirectional manner said annular valve head has a pivotal fulcrum upon a furthermost extension of said annular continuous raised ridge such that said second o-ring is freely uncompressed forming a peripheral continuous flow annular flow gap for water flow as between said second o-ring and said annular valve head, wherein each of the pair of dispensing reservoirs touch operated flow valves said valve housings have a threaded connection to a reservoir drain opening having an annular threaded flange on said reservoir bottom wall, and each said touch valve further includes an internal plug shut-off CUP having a top surface, said internal plug shut-off CUP having a to surface also further includes a distal annular flange that has an affixment to said valve seat, said shut-off CUP is adapted to cooperate in communication with said drain opening so that a liquid flow from said drain opening is shut-off in a closed channel state being defined as said top surface contacting said reservoir drain, when each of said touch valves are rotated to a tightened position via said threaded connection, and the liquid flow is in an open channel flow condition when each of said valves is rotated to a loosened position via said threaded connection resulting in an open channel state defined as said top surface having a distance from said reservoir drain, further operationally said distance may be varied via rotating said touch valves via said threaded connection to adjust a flow-rate from said reservoir in said open channel flow condition.

13. The portable hand washing station according to claim 12 wherein said affixment is sized and configured to be a snap fit removable engagement to facilitate said internal plug shut-off cup to be removable form said valve housing when said valve housing is unthreaded from said reservoir drain opening further facilitating said valve head and said valve lever arm to be removed from said inwardly tapering cylindrical opening, wherein operationally said touch operated flow valve can be completely disassembled and separated from said annular threaded flange of said bottom wall of said reservoir to facilitate complete cleaning of said reservoir and said touch operated flow valve and to facilitate replacement of said valve or said reservoir.

14. The portable hand washing station according to claim 12 wherein said valve lever arm extends away from said inwardly tapering cylindrical opening forming a longwise rod that terminates in a distal end portion to be operationally deflected by hand in an omnidirectional manner to initiate the flow of water to pass between said valve lever arm and said inwardly tapering opening.

15. The portable hand washing station according to claim 12 wherein said valve lever arm extends away from said inwardly tapering cylindrical opening terminating in a shoe portion to be operationally deflected by hand in an omnidirectional manner to initiate the flow of water to pass between said valve lever arm and said inwardly tapering opening.

16. The portable hand washing station according to claim 12 wherein said annular flow gap for water flow is sized and configured to cause the water flow to stay in contact with said valve lever arm via cohesion of the water to itself and a higher level of adhesion of the water to said valve lever arm from said valve lever arm having a surface roughness that causes the water adhesion to be greater than the water cohesion, thus operationally causing the water to flow in contact with said valve lever arm and to not separate from said valve lever arm thus minimizing loss of water to an external environment away from said valve lever arm to minimize usage of water for hand washing.

* * * * *